US006484730B1

(12) United States Patent
Smith

(10) Patent No.: US 6,484,730 B1
(45) Date of Patent: Nov. 26, 2002

(54) DEVICE FOR COLD WAVING HAIR FOR INCREASED SHEEN AND HEALTHIER HAIR

(76) Inventor: Ida M. Smith, 600 S. Holly St., Unit #5, Denver, CO (US) 80246

( * ) Notice: Subject to any disclaimer, the term of this patent is extended or adjusted under 35 U.S.C. 154(b) by 0 days.

(21) Appl. No.: 09/892,427

(22) Filed: Jun. 28, 2001

(51) Int. Cl.[7] ..... A45D 7/04; A45D 2/00
(52) U.S. Cl. ..... 132/203; 132/222
(58) Field of Search ..... 132/222, 203, 132/207, 210, 246, 226, 223, 250

(56) References Cited

U.S. PATENT DOCUMENTS

| | | | | | |
|---|---|---|---|---|---|
| 2,171,885 | A | * | 9/1939 | Michael | 132/222 |
| 3,581,056 | A | * | 5/1971 | Djenner | 132/250 |
| 3,960,156 | A | * | 6/1976 | Thompson | 132/222 |
| 4,108,183 | A | * | 8/1978 | Mauro | 132/246 |
| 4,270,555 | A | * | 6/1981 | Punte | 132/245 |
| 4,603,706 | A | * | 8/1986 | Caruso | 132/250 |
| 4,638,821 | A | * | 1/1987 | Smith | 132/222 |
| 4,993,441 | A | * | 2/1991 | Hanson | 132/226 |

* cited by examiner

*Primary Examiner*—John J. Wilson
*Assistant Examiner*—Robyn Kieu Doan
(74) *Attorney, Agent, or Firm*—Edwin H. Crabtree; Ramon L. Rizavvo; Donald W. Margolis

(57) ABSTRACT

A device and method used for cold waving and straightening hair. The cold waving device helps create a natural sheen on the hair. The cold waving hair device includes a plurality of different size clear plastic hollow rods. The hollow rods have a smooth and soft outer circumference for receiving rolled hair thereon. The different size rods receive a standard hair roller therein. Each roller includes a hair engaging line which is received along the length of the rod. The hair engaging line includes an end cap for inserting into an end cap hole in the roller. The line is used for holding the rolled hair in place against the side and length of the outer circumference of the rod. The cold waving hair device also includes plastic end wraps with a plurality of holes therein. Each end wrap is used for engaging the hair ends and wrapping the hair around the smooth outer circumference of the rod. The end wrap is used for receiving a wave solution for saturating and relaxing the hair on the different size smooth rods. After the wave solution is applied and allowed to set, the hair is then neutralized and removed from the rods and end wraps. The hair is groomed to a styled smooth and silky finish.

12 Claims, 1 Drawing Sheet

DEVICE FOR COLD WAVING HAIR FOR INCREASED SHEEN AND HEALTHIER HAIR

BACKGROUND OF THE INVENTION (a) Field of the Invention

This invention relates to a device for straightening hair and more particularly, but not by way of limitation, to a device and method of cold waving or permanent waving hair.

(b) Discussion of Prior Art

Today's procedures for permanent waving hair and straightening hair creates several problems, such as hair burning and hair breaking, which can cause lasting damage to the hair. While the damage can be minimized in appearance by using hair products like conditioners, sheen and oils, over a period of time the damage becomes more and more difficult to correct. The subject invention described herein eliminates the initial damage caused by present day hair waving and hair straightening procedures.

Heretofore, there have been a variety of different hair roller and curling devices. In U.S. Pat. No. 3,960,156 to Thompson, a hair roller is disclosed with a permanent and reusable plastic sheet or film. A portion of the plastic sheet is attached to the roller. A remaining portion of the sheet is used to receive hair strands thereon as the sheet is rolled on the roller. In U.S. Pat. No. 4,993,441 to Hanson, a permanent wave rod or roller is shown wherein the rod is made of a wettable rigid polymeric material. The rod is used with an end paper. In U.S. Pat. No. 4,465,085 to Schopieray et al., another permanent wave rod is described having a hard plastic core with a soft rubber sleeve having grooves for receiving a permanent wave solution.

In U.S. Pat. No. 4,632,132 to Bustance et al., a treated end wrap is described. The end wrap is laminated for use in permanent hair waving. The laminated end wrap includes an exterior sheet of impermeable plastic and an interior sheet of an absorbent flexible paper. The paper is impregnated with a hair waving solution. In U.S. Pat. No. 5,090,428 to Greene, a method and apparatus for treating hair is disclosed using paper sheets coated with a protein. In U.S. Pat. No. 4,854,335 to Lycett a hair curler system is described having a selected length of flexible tubing with one or more flare members. The system is used for creating different lengths and diameters of hair curls.

None of the above mentioned prior art patents specifically disclose the unique features, structure and function of the subject cold waving device for waving healthier looking hair with more natural sheen.

SUMMARY OF THE INVENTION

A primary object of the subject invention is to provide a device and method for cold waving and straightening hair which heretofore caused lasting damage to hair, Another object of the cold waving hair device is the invention has the ability to cold wave bleached hair and straighten hair that heretofore could not be cold waved or treated chemically using current hair grooming procedures.

Still another object of the hair treating device is to greatly improve the natural sheen and healthy look of the hair upon completing the method of cold waving and straightening the hair. The device includes smooth surface rods for rolling the hair around the outer circumference of the rods. The rods provide a smooth and silky surface, when wrapping the hair thereon.

Yet another object of the device is to hold down the ends of the hair with plastic end wraps. The end wraps hold moisture on the hair and help create a natural sheen on the hair. This key feature minimizes the possibility of "hair burning" or "hair breaking" and with decreased "frizzing" of the hair.

A further object of the invention is the use of different size smooth rods for reshaping the hair. Also, the different size rods are used for rearranging very curly hair to form a large permanent curl. The rods eliminate the need for oil or curl activator maintenance. Further, the rods allow a beautician to see if the hair ends are straight and smooth.

The cold waving hair device includes a plurality of different size clear plastic hollow rods, The hollow rods have a smooth and soft outer circumference for receiving rolled hair thereon. The different size rods receive a standard hair roller therein. Each roller includes a hair engaging line which is received along the length of the rod. The hair engaging line includes an end cap for inserting into an end cap hole in the roller. The line is used for holding the rolled hair in place against the side and length of the outer circumference of the rod. The cold waving hair device also includes plastic end wraps with a plurality of holes therein. Each end wrap is used for engaging the hair ends and wrapping the hair around the smooth outer circumference of the rod. The end wrap is used for receiving a wave solution for saturating and relaxing the hair on the different size smooth rods. The hair is then neutralized and removed from the rods and end wraps. After the wave solution is applied and allowed to set, the hair is groomed to a styled smooth and silky finish.

These and other objects of the present invention will become apparent to those familiar with various types of hair curling and straightening device and methods of cold waving hair when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DESCRIPTION OF THE PREFERRED EMBODIMENTS

Figure 1:
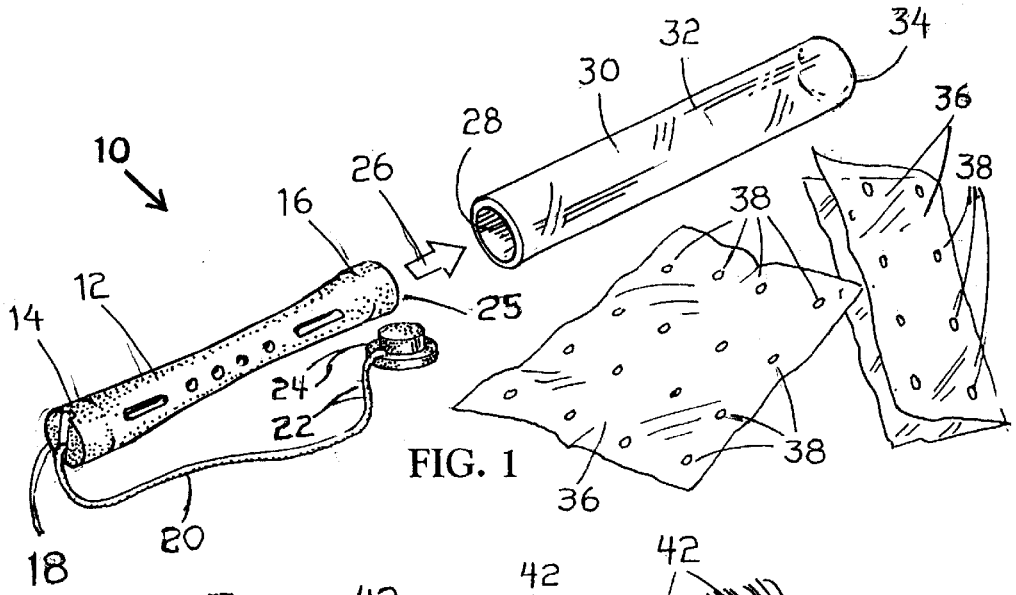
FIG. 1 illustrates a perspective view of the cold waving hair device with a hair roller positioned for receipt inside a soft plastic hollow rod. The hair device is also shown with a pair of plastic end wraps with wave solution holes therein.

In FIG. 1, a perspective view of the subject cold waving hair device is shown having general reference numeral 10. The cold waving hair device 10 includes a standard hair roller 12 having a first end 14 and a second end 16. The first end 14 is attached to one end 18 of a hair engaging line 20. An opposite end 22 of the hair engaging line 20 is attached to an end cap 24. A portion of the end cap 24 is received in an end cap hole 25 in the second end 16 of the hair roller 12 when the hair engaging line 20 is stretched along the length of the roller 12.

In this drawing, the second end 16 of the hair roller 12 is positioned for receipt, as indicated by arrow 26, inside a first open end 28 of a soft plastic hollow rod 30. The hollow rod has a soft and smooth outer circumference 32. The hair roller 12 is received inside and along the length of the hollow rod 30. The second end 16 of the roller 12 is disposed next to a second open end 34 of the rod 30.

The hair device 12 is also shown with a pair of plastic end wraps 36 with a plurality of wave solution holes 38 therein.

Figure 2:
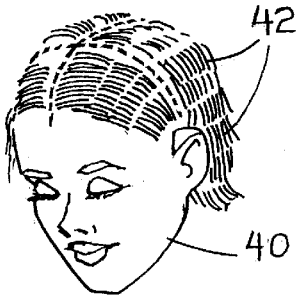
FIG. 2 illustrates a perspective view of a female model having her hair divided into 4 sections. The sections are divided from ear to ear and then from the center of the forehead to the nape of the neck.

In FIG. 2, a perspective view of a female model 40 is shown having her hair divided into 4 sections for receiving different sizes of the cold waving hair devices 10. The size of the devices 10 will vary depending on the hair style and if the hair is to be groomed into curly, wavy or straight hair. The 4 sections are shown divided from ear to ear and then from the center of the forehead to the nape of the model's neck. While the female model 40 is shown in the drawing, it should be kept in mind that the new cold waving hair device 10 will work equally well with males. Also, the waving hair device 10 can be used with various types of hair and different styles of hair worn by both males and females.

Figure 3:
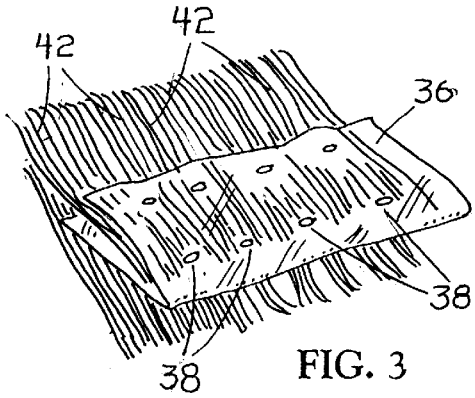
FIG. 3 is a perspective view of one of the end wraps wrapped around a portion of the hair and prior to wrapping the hair and end wrap around the hollow rod.

In FIG. 3, a perspective view of one of the plastic end wraps 36 is shown and wrapped around a portion of the ends of hair 42. The hair 42, with the end wrap 36, is now ready for receipt on and wrapping around the smooth outer circumference 32 of the hollow rod 30.

Figure 4:
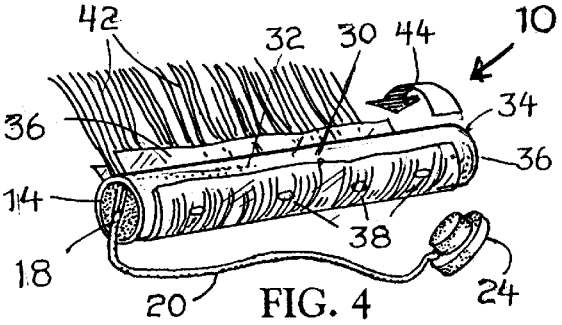
FIG. 4 is another perspective view of the end wrap with the hair therebetween, as shown in FIG. 3, and being wrapped around the hollow rod.

In FIG. 4, another perspective view of the end wrap 36 is illustrated with hair 42 received therebetween. In this drawing, the end wrap 36 and hair 42 are shown being wrapped, as indicated by arrow 44, around the outer circumference 32 of the hollow rod 30.

Figure 5:
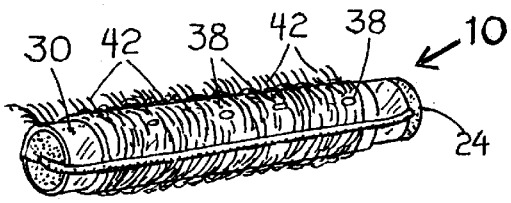
FIG. 5 is still another perspective view of the end wrap and hair wrapped around the hollow rod and held in place by the hair engaging line.

In FIG. 5, another perspective view of the end wrap 36 and hair 42 is shown and wrapped around the hollow rod 30. The end wrap 36 and the hair 42 are held in place by the hair engaging line 20. The line 20 is stretched along the length of the rod 30 with the end cap 24 received in the end cap hole 25.

Figure 6:
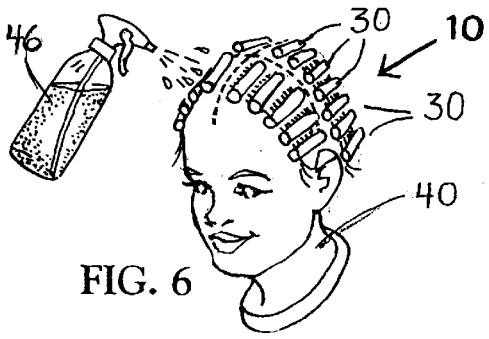
FIG. 6 is a perspective view of the female model with the 4 sections of her hair wrapped with the new cold waving devices.

In FIG. 6, a perspective view of the female model 40 is shown with the 4 sections of her hair 42 wrapped with the new cold waving devices 10. Obviously, different sizes of the device 10 are used depending on the type of hair style desired. The hair 42 is shown being sprayed with a wave solution in an applicator spray bottle 46. The wave solution is used to saturate each rolled section of the model's head and relax the hair 42.

Figure 7:
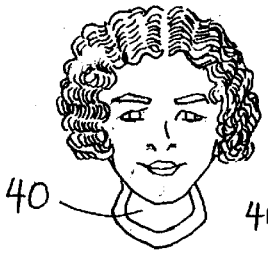
FIG. 7 is a front view of a female model with her hair groomed in a wavy hair style.

In FIG. 7, a front view of the female model 40 is illustrated with her hair groomed in a wavy hair style. In this example, smaller cold waving devices 10 would be used with the devices more closely spaced.

Figure 8:
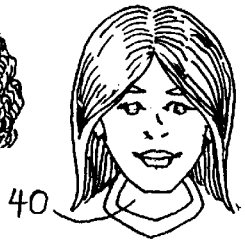
FIG. 8 is a front view of another female model with her hair groomed in a straight hair style.

In FIG. 8, a front view of another female model 48 is illustrated with her hair groomed in a straight hair style. In this example, large cold wave devices 10 would be used with the large rods less closely spaced.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed are defined as follows:

1. A method used for cold waving and straightening hair on a person's head, the method helping create a natural sheen on the hair, the method using a hollow rod having an unrestricted soft and smooth outer circumference therearound, the hollow rod having a hair roller received therein, the hair roller having a hair engaging line which is received along a length of the hollow rod and held thereagainst, the method steps comprising:

inserting a hair roller inside and along a length of the hollow rod, a first end of the hair roller disposed next to a first open end of the hollow rod and a second end of the hair roller disposed next to a second open end of the hollow rod;

wrapping a plastic end wrap with holes therein around hair ends;

wrapping the plastic end wrap with the hair ends and hair around the unrestricted soft and smooth outer circumference of the hollow rod;

securing the plastic end wrap with the hair ends and hair around the outer circumference of the hollow rod using the hair engaging line;

applying a wave solution on the hair ends and hair for saturating and relaxing the hair on the hollow rod; and removing the hollow rod and the plastic end wrap from the hair ends and hair and grooming the hair to a selected hair style.

2. The method as described in claim 1 further including the step of first dividing the person's head into at least two sections for receiving a plurality of hollow rods with hair rollers received therein.

3. The method as described in claim 1 further including the step of first dividing the person's head into at least two sections for receiving a plurality of different size hollow rods with hair rollers received therein.

4. The method as described in claim 1 further including the step of first dividing the person's head into four sections for receiving a plurality of hollow rods with hair rollers received therein.

5. The method as described in claim 1 further including the step of first dividing the person's head into four sections for receiving a plurality of different size hollow rods with hair rollers received therein.

6. A method used for cold waving and straightening hair on a person's head, the method helping create a natural sheen on the hair, the method using a plurality of hollow rods having an unrestricted soft and smooth outer circumference therearound, the hollow rods having hair rollers received therein, the hair rollers having a hair engaging line which is received along a length of the hollow rods and held thereagainst, the method steps comprising:

inserting the hair rollers inside and along a length of the plurality of hollow rods, a first end of each hair roller disposed next to a first open end of each hollow rod and a second end of each hair roller disposed next to a second open end of each hollow rod;

wrapping a plastic end wrap with holes therein around hair ends;

wrapping the plastic end wrap with the hair ends and hair around the unrestricted soft and smooth outer circumference of the hollow rods;

securing the plastic end wrap with the hair ends and hair around the outer circumference of the hollow rods using the hair engaging line;

applying a wave solution on the hair ends and hair for saturating and relaxing the hair on the hollow rods; and removing the hollow rods and the plastic end wrap from the hair ends and hair and grooming the hair to a selected hair style.

7. The method as described in claim 6 further including the step of first dividing the person's head into at least two sections for receiving the plurality of the hollow rods with hair rollers received therein.

8. The method as described in claim 6 further including the step of first dividing the person's head into at least two sections for receiving a plurality of different size hollow rods with hair rollers received therein.

9. The method as described in claim 6 further including the step of first dividing the person's head into four sections for receiving the plurality of hollow rods with hair rollers received therein.

10. The method as described in claim 9 wherein the four sections of the person's head is divided from ear to ear and then from a center of the forehead to a nape of the person's neck.

11. The method as described in claim 6 further including the step of first dividing the person's head into four sections for receiving a plurality of different size hollow rods with hair roller received therein.

12. The method as described in claim 11 wherein the four sections of the person's head is divided from ear to ear and then from a center of the forehead to a nape of the person's neck.

* * * * *